US010407863B2

(12) United States Patent
Cutler et al.

(10) Patent No.: US 10,407,863 B2
(45) Date of Patent: Sep. 10, 2019

(54) WIDE-END TRENCHER BOOM

(71) Applicant: Vermeer Manufacturing Company, Pella, IA (US)

(72) Inventors: Edward Cutler, Bloomfield, IA (US); Joshua Seibert, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 153 days.

(21) Appl. No.: 15/071,870

(22) Filed: Mar. 16, 2016

(65) Prior Publication Data

US 2016/0273183 A1 Sep. 22, 2016

Related U.S. Application Data

(60) Provisional application No. 62/148,258, filed on Apr. 16, 2015, provisional application No. 62/133,858, filed on Mar. 16, 2015.

(51) Int. Cl.

| | |
|---|---|
| ***E02F 3/08*** | (2006.01) |
| ***E02F 3/14*** | (2006.01) |
| ***E02F 5/06*** | (2006.01) |
| ***E02F 5/08*** | (2006.01) |

(52) U.S. Cl.

CPC ..... *E02F 3/085* (2013.01); *E02F 3/088* (2013.01); *E02F 3/143* (2013.01); *E02F 3/148* (2013.01); *E02F 5/06* (2013.01); *E02F 5/08* (2013.01)

(58) Field of Classification Search

CPC . E02F 3/085; E02F 3/088; E02F 3/143; E02F 3/148; E02F 5/06; E02F 5/08

See application file for complete search history.

(56) References Cited

U.S. PATENT DOCUMENTS

| | | | | |
|---|---|---|---|---|
| 3,540,139 | A * | 11/1970 | Dye | E02F 3/085 172/145 |
| 3,614,162 | A | 10/1971 | Teeter | |
| 4,755,001 | A | 7/1988 | Gilbert | |
| 6,543,963 | B2 * | 4/2003 | Bruso | A01B 33/021 111/118 |
| 6,658,767 | B2 | 12/2003 | Kelly et al. | |
| 8,176,662 | B2 | 5/2012 | Peterson | |
| 9,587,373 | B2 * | 3/2017 | Gift | E02F 3/9212 |

(Continued)

FOREIGN PATENT DOCUMENTS

| | | |
|---|---|---|
| EP | 1288376 A2 | 3/2003 |
| GB | 2368358 A | 5/2002 |

OTHER PUBLICATIONS

Extended European Search Report for European Application No. 16160098.6 dated Aug. 3, 2016 (6 pgs).

*Primary Examiner* — Jamie L McGowan

(74) *Attorney, Agent, or Firm* — Merchant & Gould P.C.

(57) ABSTRACT

A trencher that is convertible between first and second trenching configurations so that when the trencher is in the first trenching configuration, a trencher boom includes a first trenching portion at the distal end of the boom and a second trenching portion that extends along a longitudinal axis from the first trenching portion toward the proximal end. The first trenching portion defines a first trench width, and the second trenching portion defines a second trench width. The first trench width is larger than the second trench width. The second trenching portion has a greater length measured along the longitudinal axis as compared to the first trenching portion.

18 Claims, 15 Drawing Sheets

(56) References Cited

U.S. PATENT DOCUMENTS

| | | | |
|---|---|---|---|
| 2002/0012572 | A1 | 1/2002 | Bruso |
| 2004/0231202 | A1 | 11/2004 | Whitten et al. |
| 2009/0260264 | A1 | 10/2009 | Cooper et al. |

* cited by examiner

DIRECTION OF TRAVEL
R
F 20
16
14
24
42

16
14
20
60
42
73

16
14
20
71
60
42
73

16
14
20
60
42
73
65

16
14
20
60
42
73

WIDE-END TRENCHER BOOM

TECHNICAL FIELD

The present disclosure generally relates to excavation machines. More particularly, the present disclosure relates to trench-digging machines.

BACKGROUND

Off-road excavation machines are commonly used to efficiently provide a number of different excavation related functions. Two example types of excavation machines include trenchers and surface planers (i.e., surface miners or surface profilers). Trenchers are typically used to excavate trenches for use in installing utilities such as underground pipe or conduit for cable. In comparison to trenchers, surface planers are typically used to excavate a wider, shallower, top layer of material (e.g., for surface mining, surface preparation or pavement removal applications).

A trencher generally includes a chassis supported on a propulsion system having ground engaging tracks or tires. A trenching boom is pivotally connected to the chassis and is pivotally movable relative to the chassis between a raised transport position and a lowered trenching position. A trenching chain is mounted on the trenching boom. The trenching chain carries a plurality of excavating teeth and is driven along a continuous path that extends around the length of the boom. Example trenchers are shown by US Patent Publication No. 2009/0260264 and U.S. Pat. Nos. 6,658,767; 7,930,843; and 8,176,662.

A surface planer also generally includes a chassis supported on a propulsion system having ground engaging tracks or tires. An excavating drum is carried by the chassis. The excavating drum can be boom mounted or mounted beneath the chassis. The excavating drum typically carries a plurality of excavating teeth. Example surface miners are shown by US Patent Publication No. 2014/0007465 and U.S. Pat. Nos. 3,614,162; 4,755,001; 6,948,265; and 8,955,919.

SUMMARY

Prior art trenching and surface planing machines each typically are configured to provide a single excavating width. In contrast, aspects of the present disclosure relate to an excavating machine that can readily be converted between different configurations to provide different excavating widths. In one example, aspects of the present disclosure relate to a trencher that can be readily converted between a first configuration where the trencher cuts a first trench width and a second configuration where the trencher cuts a second trench width.

Aspects of the present disclosure also relate to trenching machines and methods that allow relatively wide trenches to be efficiently excavated with relatively low power requirements. In certain aspects, the trenching methods include first excavating a trench having one or more undercut regions and a non-undercut region, and then second removing the one or more undercut regions. In one example, the trench is excavated using a trencher having a trenching boom, and the boom is raised to remove the one or more undercut regions. In one example, the non-undercut region is excavated by a trenching chain carried by the trenching boom, and the undercut regions are excavated by excavating drum portions mounted on opposite sides of the trenching chain at a distal end of the trenching boom.

In one aspect, the present disclosure relates to a trencher with a chassis having a front end and a back end and a propulsion system for moving the chassis. The trencher includes a trencher boom mounted to the back end of the chassis. The trencher boom is pivotally movable relative to the chassis between a raised position and a lowered position. The trencher boom includes a proximal end pivotally mounted to the chassis and a distal end. The trencher boom defines a longitudinal axis that extends between the proximal and distal ends of the boom. The trencher boom also includes a boom frame that extends longitudinally along the longitudinal axis of the boom. The trencher boom has a top side and a bottom side. The trencher boom includes a first trenching portion at the distal end of the boom and a second trenching portion that extends along the longitudinal axis from the first trenching portion toward the proximal end. The first trenching portion defines a first trench width, and the second trenching portion defines a second trench width. The first trench width is larger than the second trench width. The second trenching portion has a greater length measured along the longitudinal axis as compared to the first trenching portion. The trencher boom includes a trenching chain that moves along a continuous path that extends around a length of the boom frame. The trenching chain defines a chain width that corresponds to the second trench width. The chain turns about a first axis at the proximal end of the boom and a second axis at the distal end of the boom. The trencher boom includes first and second trench wideners positioned at the distal end of the trencher boom on opposite sides of the trenching chain. The first and second trench wideners are configured to rotate about the second axis as the chain is driven along the continuous path. The first and second trench wideners cooperate to define the outer extents of the first trench width. The trenching chain includes a main chain body and a plurality of chain teeth carried with the main chain body. The chain teeth are oriented such that tips of the chain teeth face at least partially in a rearward direction when the chain teeth are traveling along the top side of the trencher boom, and face at least partially in a forward direction when the chain teeth are traveling along the bottom side of the trencher boom. The first and second trench wideners respectively include first and second drum sections carrying drum teeth. The drum teeth are oriented such that tips of the drum teeth face at least partially in the rearward direction when the drum teeth are directly over their respective first and second drum sections, and face at least partially in the forward direction when the drum teeth are directly under their respective first and second drum sections.

Optionally, the trenching chain rides on a sprocket at the distal end of the trenching boom. The sprocket rotates about the second axis. The second axis is defined by a shaft that is fixed relative to the boom frame. The sprocket is mounted to the shaft by at least one bearing that allows the sprocket to rotate about the shaft. The first and second trench wideners rotate in unison with the sprocket about the second axis. The shaft width is narrower than the second trench width.

In another aspect, the present disclosure relates to a convertible trencher including a chassis with a front end and a back end, a propulsion system for moving the chassis, and a trencher boom. The trencher boom is mounted to the back end of the chassis. The trencher boom is pivotally movable relative to the chassis between a raised position and a lowered position. The trencher boom includes a proximal end pivotally mounted to the chassis and a distal end. The trencher boom defines a longitudinal axis that extends between the proximal and distal ends of the boom. The trencher boom also includes a boom frame that extends longitudinally along the longitudinal axis of the boom. The trencher boom has a top side and a bottom side. The trencher is convertible between first and second trenching configurations. When the trencher is in the first trenching configuration, the trencher boom includes a first trenching portion at the distal end of the boom and a second trenching portion that extends along the longitudinal axis from the first trenching portion toward the proximal end. The first trenching portion defines a first trench width, and the second trenching portion defines a second trench width. The first trench width is larger than the second trench width. The second trenching portion has a greater length measured along the longitudinal axis as compared to the first trenching portion. When the trencher is in the second trenching configuration, the trenching boom is configured to only trench the second trenching width.

In still another aspect, the present disclosure relates to a method for trenching using a trencher having a trenching boom with a proximal end and a distal end. The trencher boom includes a first trenching portion at the distal end of the boom and a second trenching portion that extends along a longitudinal axis of the trenching boom from the first trenching portion toward the proximal end. The first trenching portion defines a first trench width, and the second trenching portion defines a second trench width. The first trench width is larger than the second trench width. The second trenching portion has a greater length measured along the longitudinal axis as compared to the first trenching portion. The trencher boom includes a frame and a trenching chain that moves along a continuous path that extends around a length of the boom frame. The trenching chain defines a chain width that corresponds to the second trench width. The chain turns about a first axis at the proximal end of the boom and a second axis at the distal end of the boom. The trencher boom includes first and second trench wideners positioned at the distal end of the trencher boom on opposite sides of the trenching chain. The first and second trench wideners are configured to rotate about the second axis as the chain is driven along the continuous path. The first and second trench wideners cooperate to define the outer extents of the first trench width, thus permitting a larger width trench to be cut than would have been possible using the trencher boom alone. The method includes forming a trench with the trenching boom by moving the trenching boom within the ground such that the first and second trench wideners excavate undercut sections of the trench while the trenching chain excavates a non-undercut section of the trench. The method also includes raising the boom to cause the first and second trench wideners to excavate material from above the undercut sections of the trench.

DESCRIPTION OF EXAMPLE EMBODIMENTS

Figure 1:
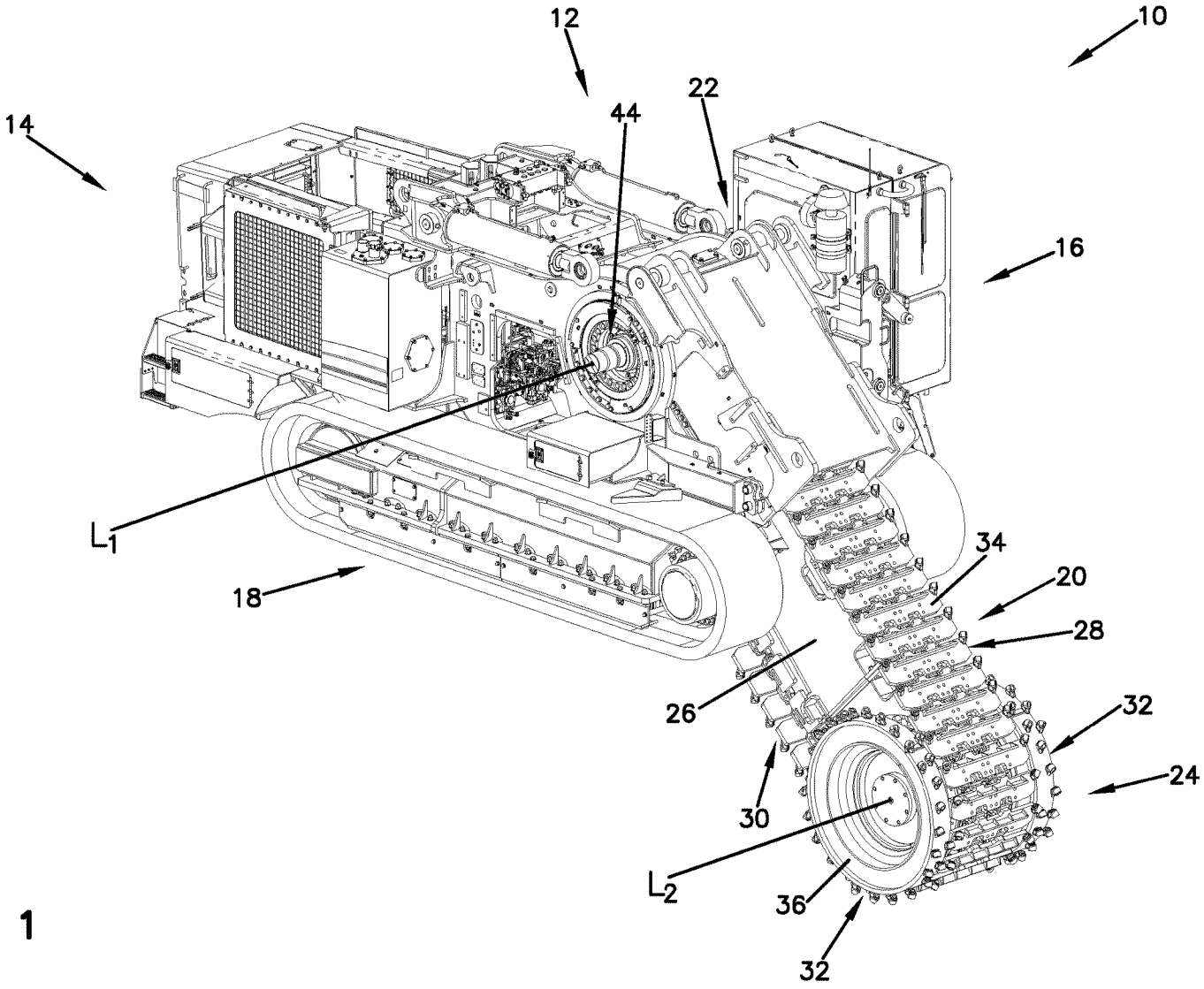
FIG. 1 is an isometric view of a trencher according to a first example embodiment of the present disclosure.
Figure 2:
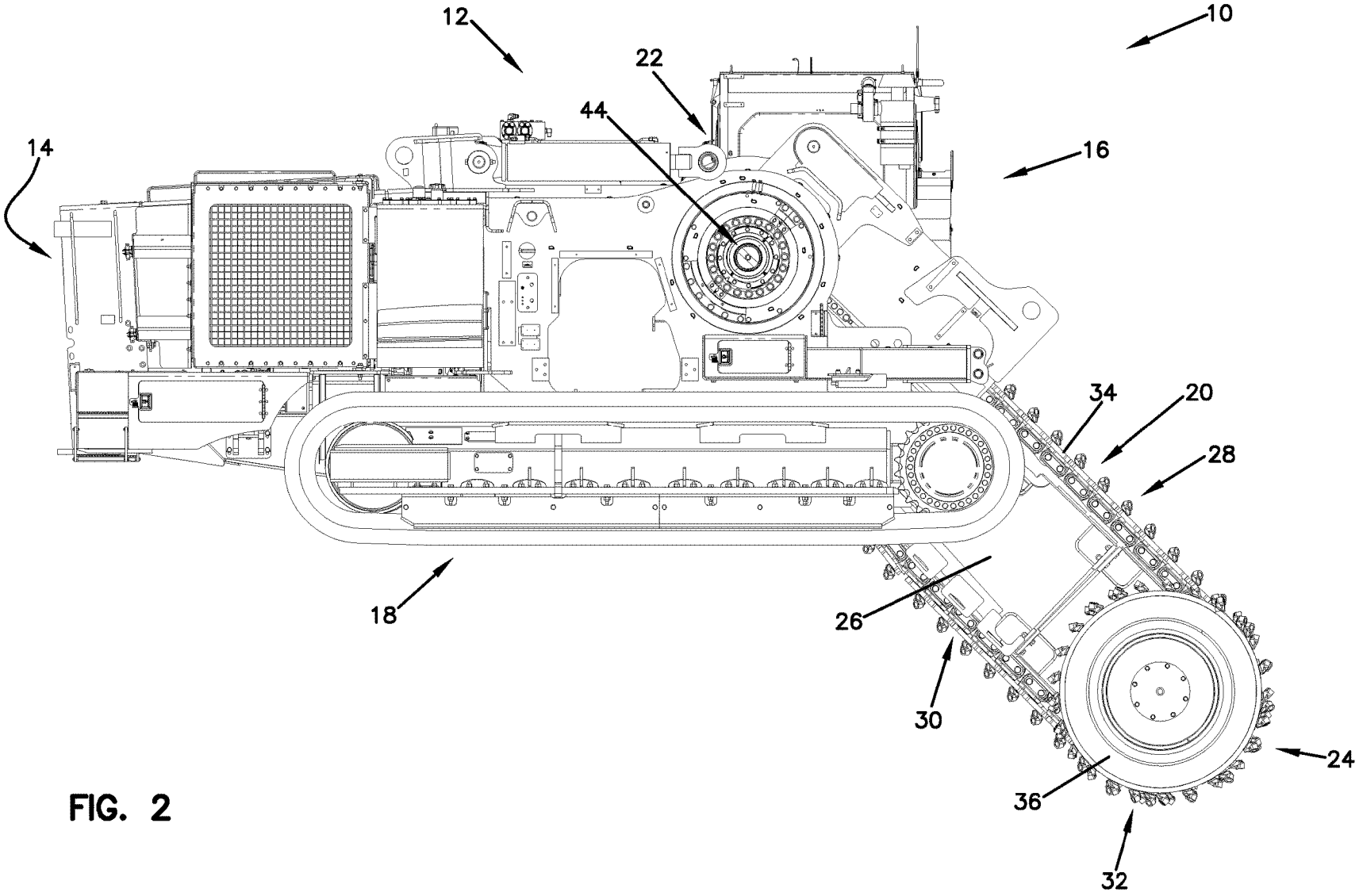
FIG. 2 is a side view of the trencher shown in FIG. 1.
Figure 3:
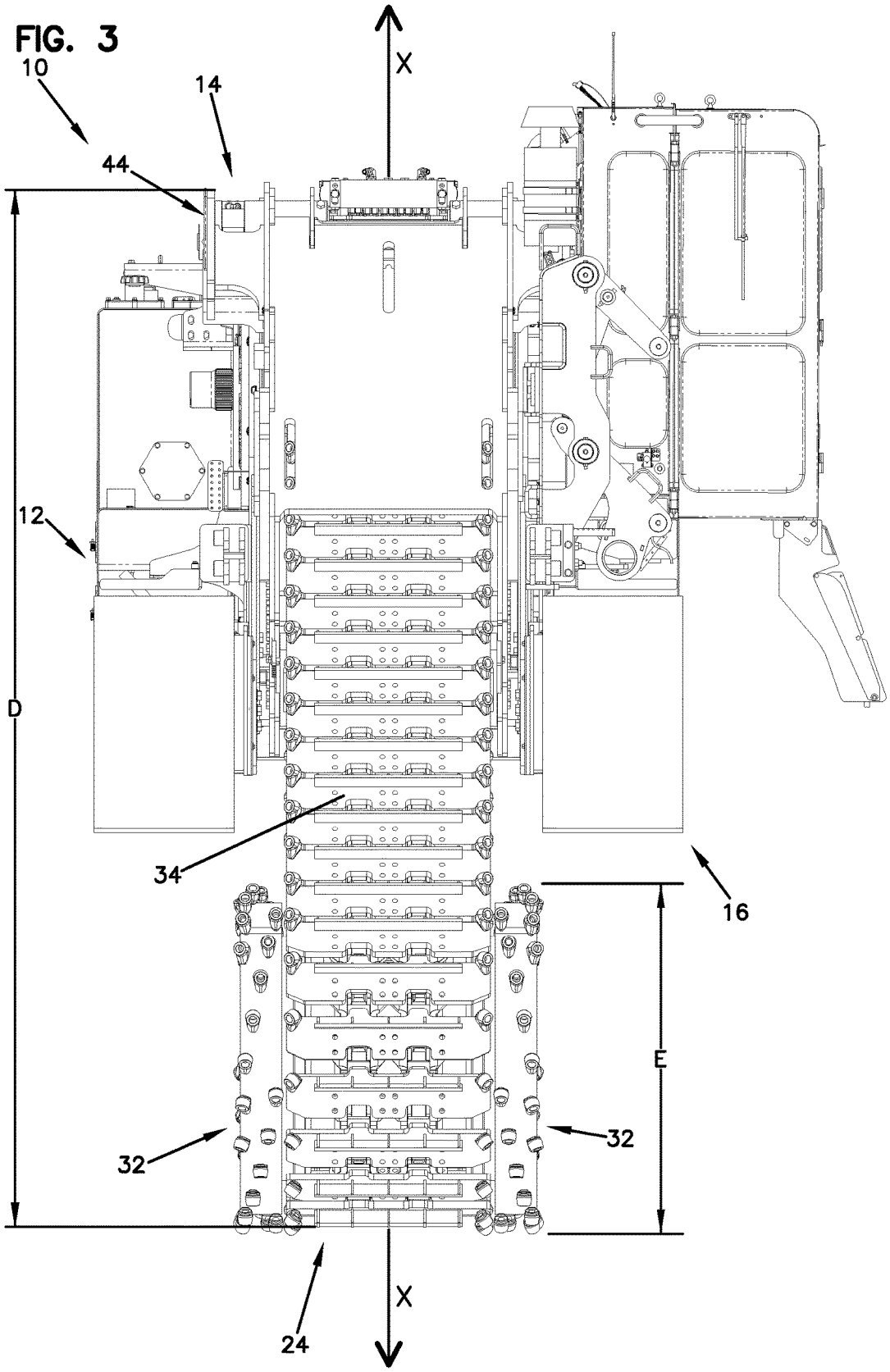
FIG. 3 is a rear view of the trencher shown in FIG. 1.
Figure 4:
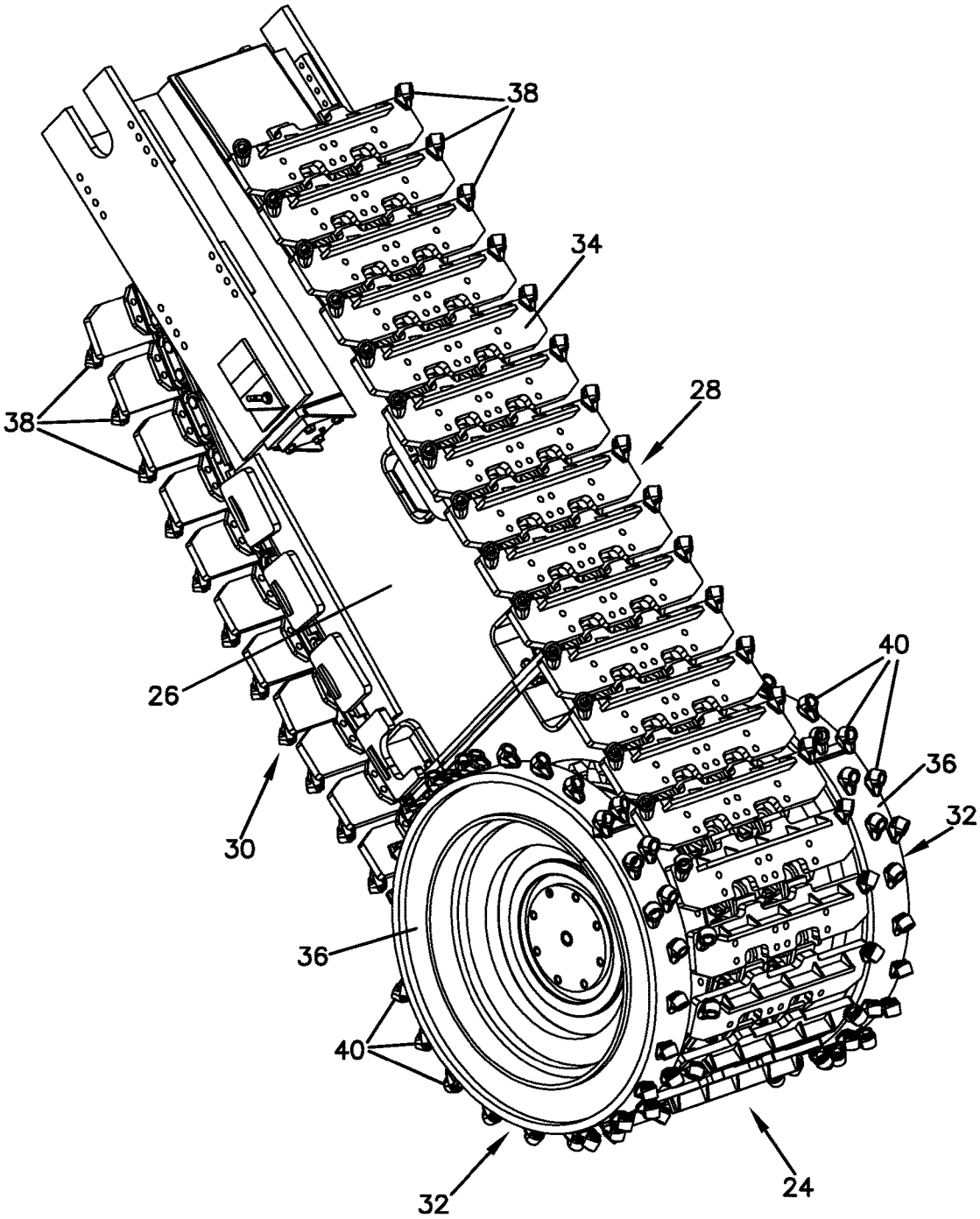
FIG. 4 is a partial isometric view of the trencher boom, isolated from the trencher shown in FIG. 1.

FIGS. 1-8 depict a trencher 10 according to an example embodiment. The depicted trencher 10 has a chassis 12 with a front or forward end 14 and a back or rear end 16. As particularly shown in FIGS. 1-3, the trencher 10 has a propulsion system 18 for moving the chassis 12 forward F and rearward R along a direction of travel (FIGS. 12A-12E). The propulsion system 18 can include tracks, as depicted, or tires (not shown) as would be understood by one of ordinary skill in the art.

As depicted, the example trencher 10 has a trencher boom 20 mounted to the back or rear end 16 of the chassis 12. The trencher boom 20 is pivotally movable relative to the chassis 12 between a raised position and a lowered position (FIGS. 13A-13E).

As depicted, the example trencher boom 20 has a proximal end 22 that is pivotally mounted to the chassis 12 according to methods understood by one of ordinary skill in the art. Opposite the proximal end 22, the trencher boom 20 has a distal free end 24. The trencher boom 20 defines a longitudinal axis X (FIG. 3) that extends between the proximal end 22 and the distal free end 24 of the boom 20. The trencher boom 20 has a boom frame 26 that extends longitudinally along the longitudinal axis X of the boom. The trencher boom 20 has a top side 28 and a bottom side 30.

As depicted, the example trencher boom 20 includes a first trenching portion at the distal end 24 of the boom and a second trenching portion that extends along the longitudinal axis X from the first trenching portion toward the proximal end 22. As particularly shown in FIG. 8, the first trenching portion defines a first trench width A, and the second trenching portion defines a second trench width B. The depicted first trench width A is larger than the second trench width B. As particularly shown in FIG. 3, the second trenching portion has a greater length measured along the longitudinal axis X than the first trenching portion. The depicted first trenching portion has a length E measured along the longitudinal axis X that is less than one half of a total length D of the trencher boom 20.

As depicted, the example trencher boom 20 includes a trenching chain 34 that moves along a continuous path extending around a length of the boom frame 26 along the longitudinal axis X between the proximal end 22 and the distal end 24. The trenching chain 34 defines a chain width that corresponds to the second trench width B. The trenching chain 34 turns about a first axis $L_1$ at the proximal end 22 of the boom 20, and about a second axis $L_2$ at the distal end 24 of the trencher boom (FIG. 1).

As depicted, the example trencher boom 20 includes first and second trench wideners 32 positioned at the distal end 24 of the trencher boom, on opposite sides of the trenching chain 34. The first and second trench wideners 32 are configured to rotate about the second axis $L_2$ as the trenching chain 34 is driven along the continuous path. The first and second trench wideners 32 cooperate to define the outer extents of the first trench width A. As illustrated, the first trench width A, defining a width with the first and second trench wideners 32, is wider than the second trench width B, defining a trench width without the first and second trench wideners. Each of the depicted first and second trench wideners 32 preferably has a cutting width that is less than 0.75 times as large as the trenching chain 34, which defines the second trench width B. More preferably, each of the depicted first and second trench wideners 32 has a cutting width that is less than 0.50 times as large as the trenching chain 34, which defines the second trench width B.

As depicted, the example trencher 10 can be convertible between first and second trenching configurations. In the first trenching configuration, the trencher boom 20 includes the first trenching portion defining the first trench width A at the distal end 24 of the boom, and the second trenching portion defining the second trench width B extending along the longitudinal axis X from the first trenching portion toward the proximal end 22. In the second trenching configuration, the trenching boom 20 is configured to only trench the second trenching width B.

As depicted, the example first and second trench wideners 32 respectively include first and second drum sections 36 having a plurality of cutter pockets 40 for receiving and securing a plurality of drum cutters 41. Example drum cutters 41 can include teeth rotatably secured within the cutter pockets 40. Alternatively, spade bits or cup cutters (not shown) can function similarly to drum cutters 41, and can be secured directly to the first and second drum sections 36. As understood by one of ordinary skill in the art, each cutter pocket 40 can rotatably receive a drum cutter 41, thus providing drum cutters around the entire circumference of the drum sections 36.

Figure 5:
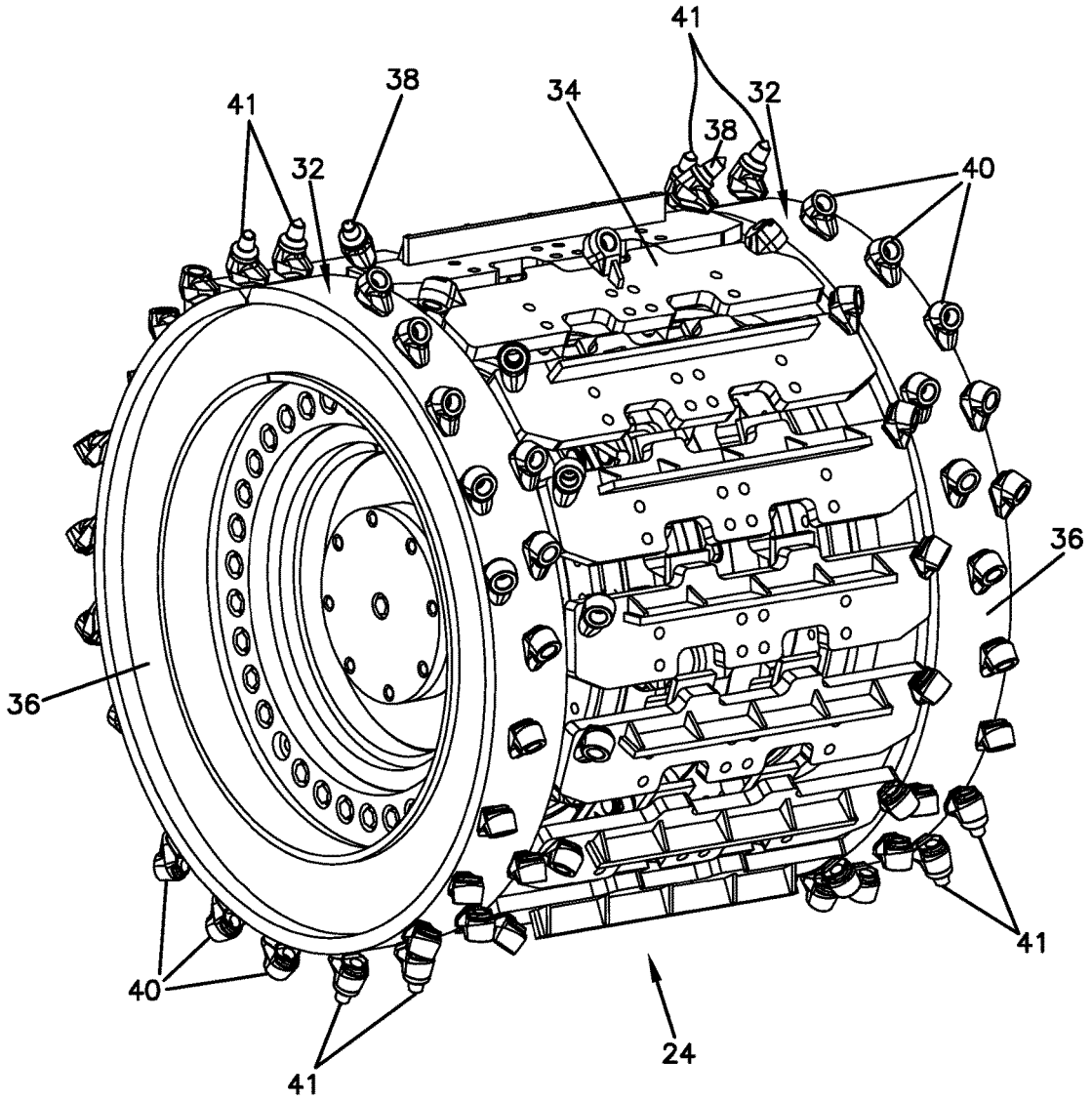
FIG. 5 is a front-side isolated isometric view of the distal end of the trencher boom shown in FIG. 1.
Figure 6:
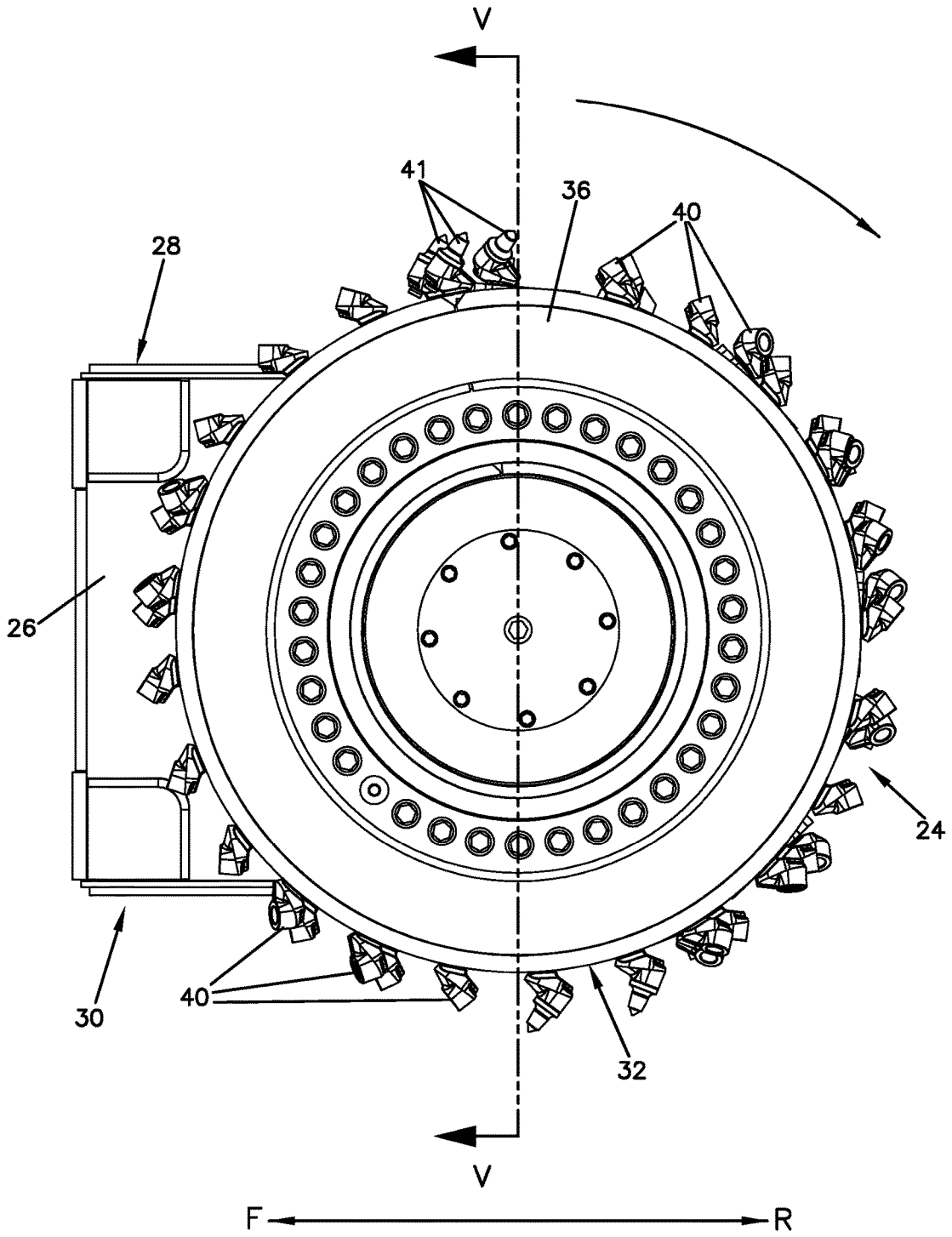
FIG. 6 is a side view of the distal end of the trencher boom shown in FIG. 1.
Figure 7:
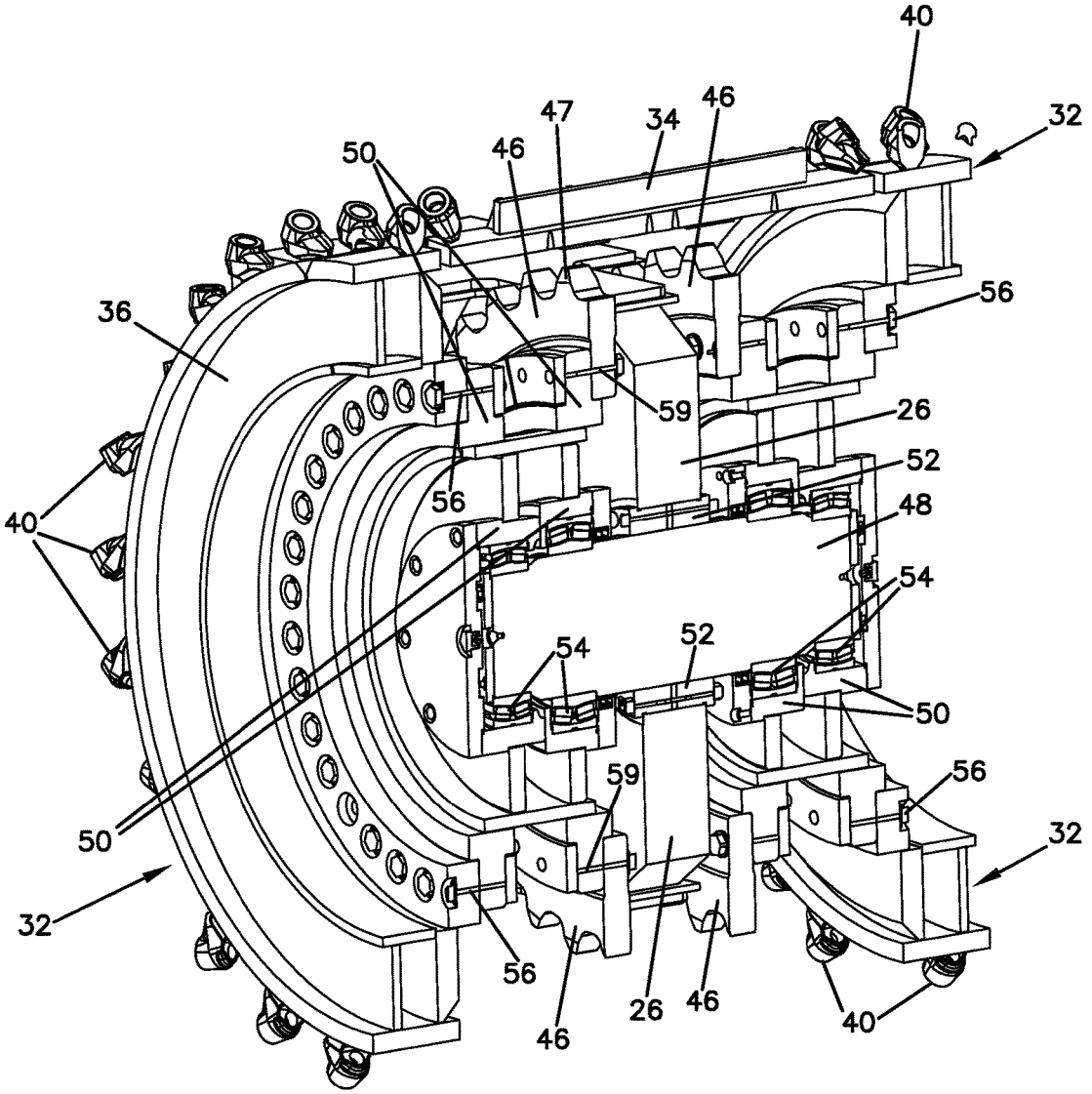
FIG. 7 is a front-side isometric cut-away view of the distal end of the trencher boom shown in FIG. 1, as viewed along Line V in FIG. 6.

As depicted, the example drum cutters 41, through the placement and arrangement of corresponding cutter pockets 40, can be oriented such that distal tips of the drum cutters face at least partially in the forward direction F toward the chassis 12 when the drum cutters are directly under their respective first and second drum sections, and face at least partially in the rearward direction R away from the chassis when the drum cutters are directly over their respective first and second drum sections (FIGS. 5-7). For the purposes of explanation only, these several views show several example cutter pockets 40 without example drum cutters 41 secured within. It will be understood by one of ordinary skill in the art that each and every depicted cutter pocket 40 can secure a drum cutter 41 during operation. These forward F and rearward R directions of the cutters 41 are in reference to the direction of travel of the trencher 10. (FIGS. 12A-12E).

As depicted, the example drum cutters 41 can be positioned within the cutter pockets 40 to be aligned along an axis parallel to the longitudinal axis X. Alternatively, the drum cutters 41 can be positioned within the cutter pockets 40 to be angled askew of an axis parallel to the longitudinal axis X. In the askewed position, drum cutters 41 that are rotatably secured within the cutter pockets 40 can be rotated more easily within their respective pockets, thus reducing wear on the cutters.

As depicted, the example trenching chain 34 includes a main chain body and a plurality of chain cutters 38 carried with the main chain body. As particularly depicted in FIG. 2, the chain cutters 38 can be oriented such that distal tips of the chain cutters face at least partially in a forward direction F toward the chassis 12 when the chain cutters are traveling along the bottom side 30 of the trencher boom 20, and face at least partially in a rearward direction R away from the chassis when the chain cutters are traveling along the top side 28 of the trencher boom. These forward and rearward directions of the cutters 38 are in reference to the direction of travel of the trencher 10 (FIGS. 12A-12E). The chain cutters 38 can be secured with pockets, similarly to the drum cutters 41, or secured directly to the trenching chain 34.

As depicted, the example trencher 10 includes a drive mechanism 44 for driving the trenching chain 34 about the continuous path. During trenching, the trenching chain 34 can be driven in a first direction in which the trenching chain transitions from the bottom side 30 of the trenching boom 20 to the top side 28 of the trenching boom at the proximal end 22 of the trenching boom, and transitions from the top side of the trenching boom to the bottom side of the trenching boom at the distal end 24 of the trenching boom.

Figure 8:
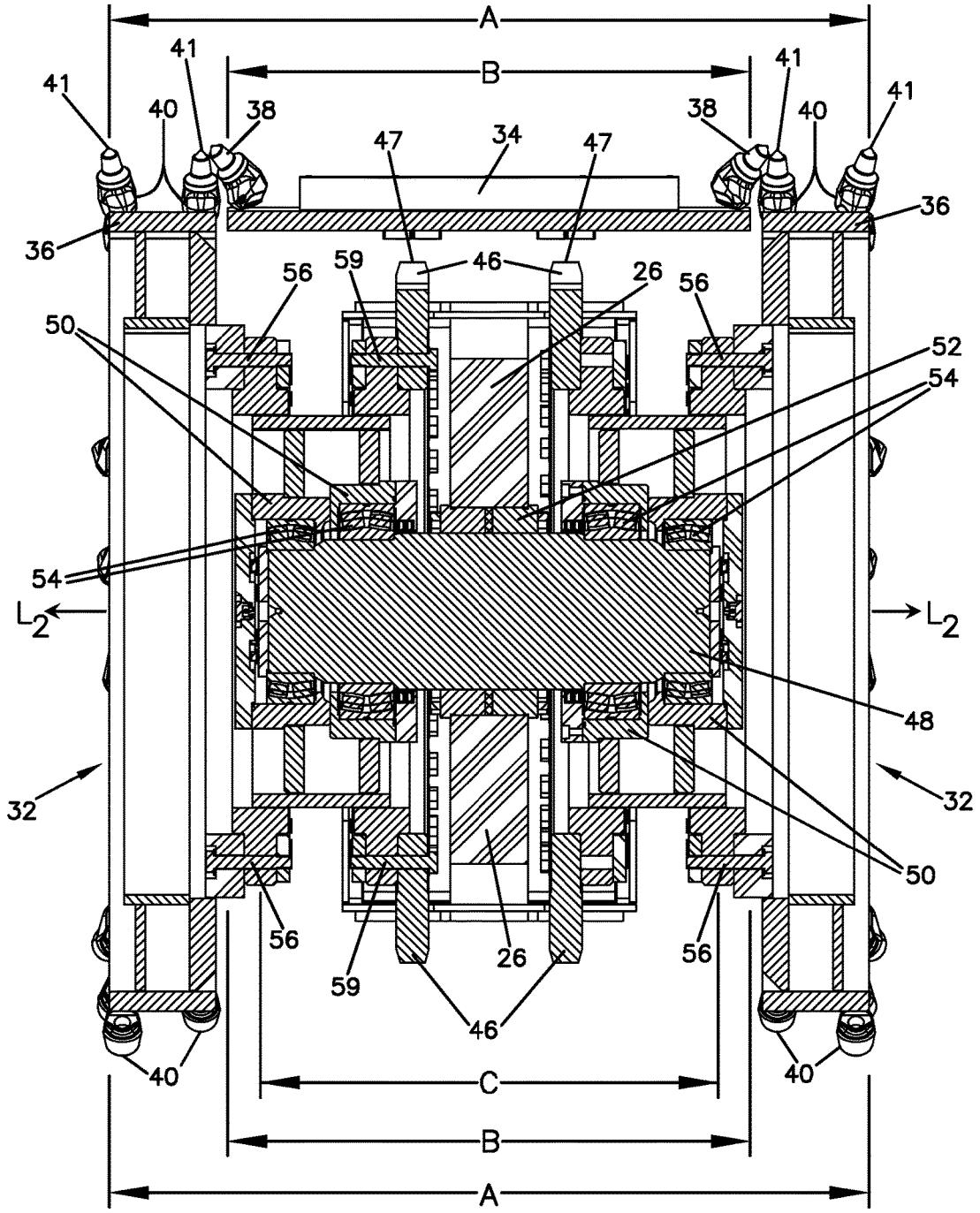
FIG. 8 is a cross-sectional view of the distal end of the trencher boom shown in FIG. 1, as viewed along Line V in FIG. 6.

As particularly depicted in FIGS. 7-8, the example trenching chain 34 rides on a sprocket 46 at the distal end 24 of the trenching boom 20. The depicted sprocket 46 includes a plurality of teeth 47 that engage the chain 34. The chain 34 and the sprocket 46 rotate about a shaft 48 around the boom distal end 24 from the top side 28 to the bottom side 30. The sprocket 46 rotates about the second axis $L_2$. The second axis $L_2$ is defined by the shaft 48 that is fixed relative to the boom frame 26, for example by a fitting 52. The sprocket 46 is mounted to the shaft 48 by at least one bearing 54 that allows the sprocket to rotate about the shaft. The first and second drum sections 36 rotate in unison with the sprocket 46 about the second axis $L_2$. As depicted, the shaft 48 width D is narrower than the second trench width B.

As would be understood by one of ordinary skill in the art, the first and second drum sections 36 can be mechanically coupled to the sprocket 46. For example, the first and second drum sections 36 can be releasably coupled to a hub 50 that rotates in unison with the sprocket 46. For example, the first and second drum sections 36 can be coupled to the hubs 50 with fasteners 56, such as bolts or pins. The hubs 50 additionally can be secured to the sprocket 46 with fasteners 59, such as bolts or pins. This mechanical effect causes torque to be transferred to the drum sections 36 from the hub 50.

Figure 9:
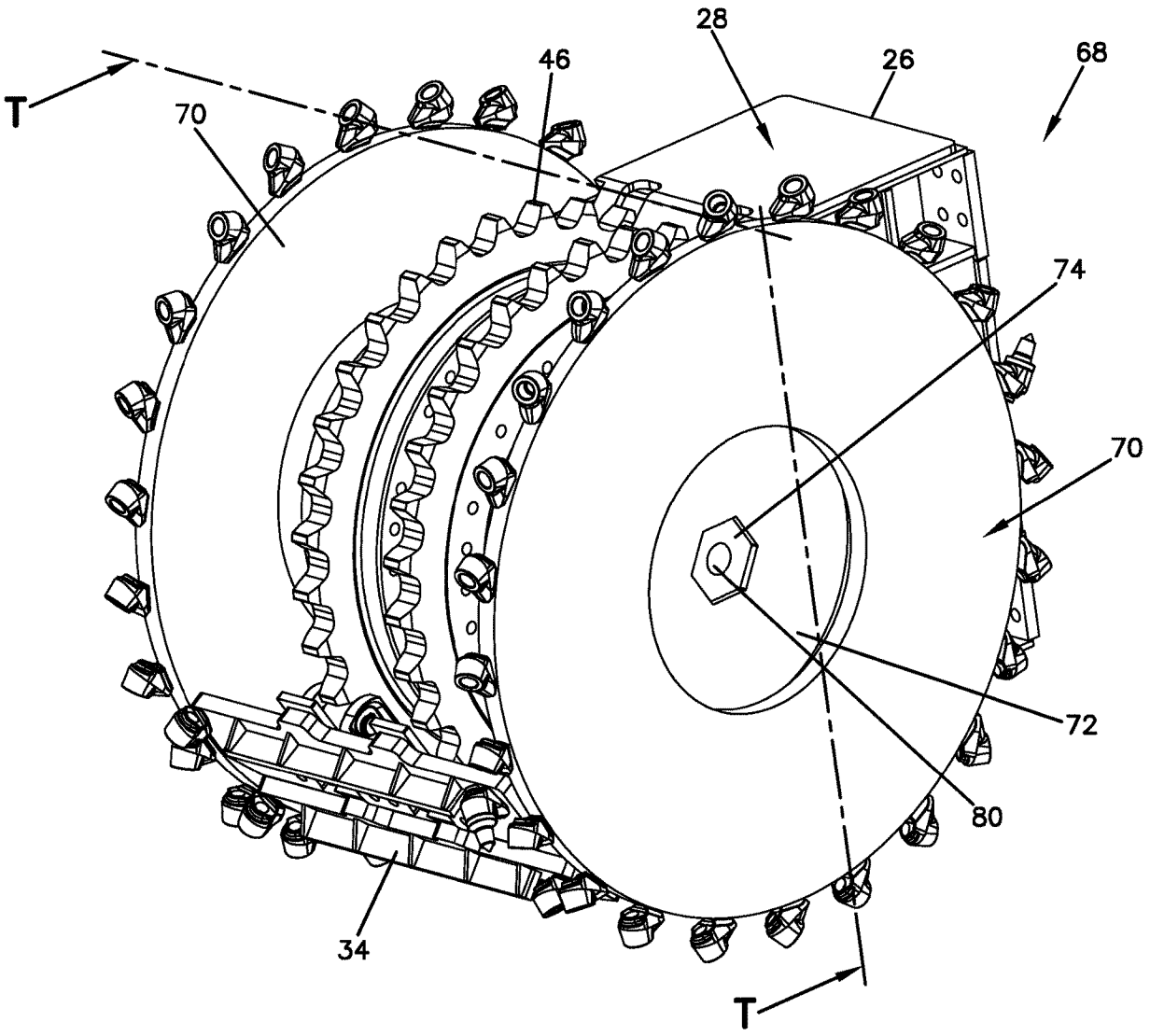
FIG. 9 is a front-side isolated isometric view of a distal end of a trencher boom according to a second example embodiment of the present invention.
Figure 10:
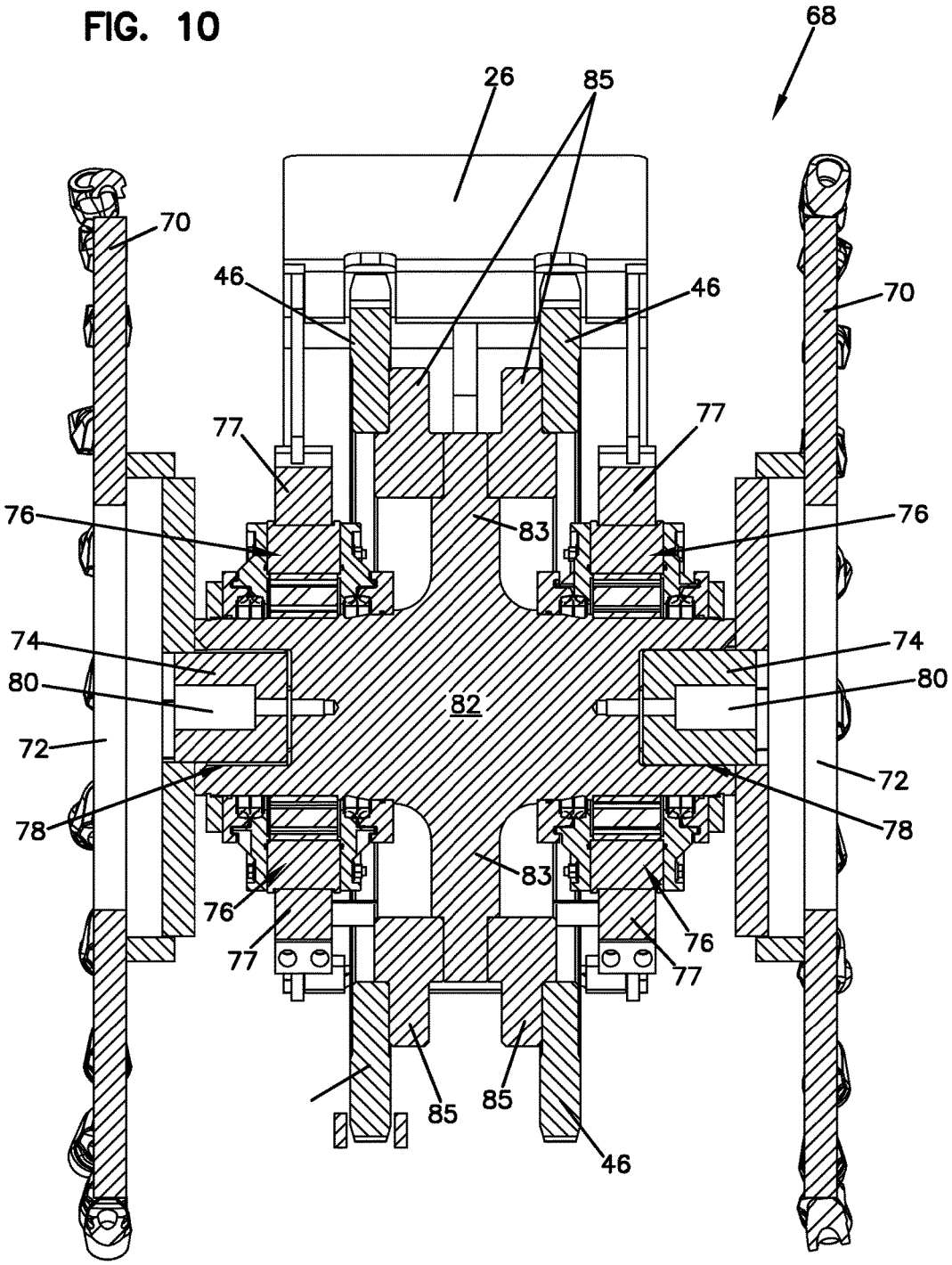
FIG. 10 is a cross-sectional view of the distal end of the trencher boom in FIG. 9, as viewed along Line T.
Figure 11:
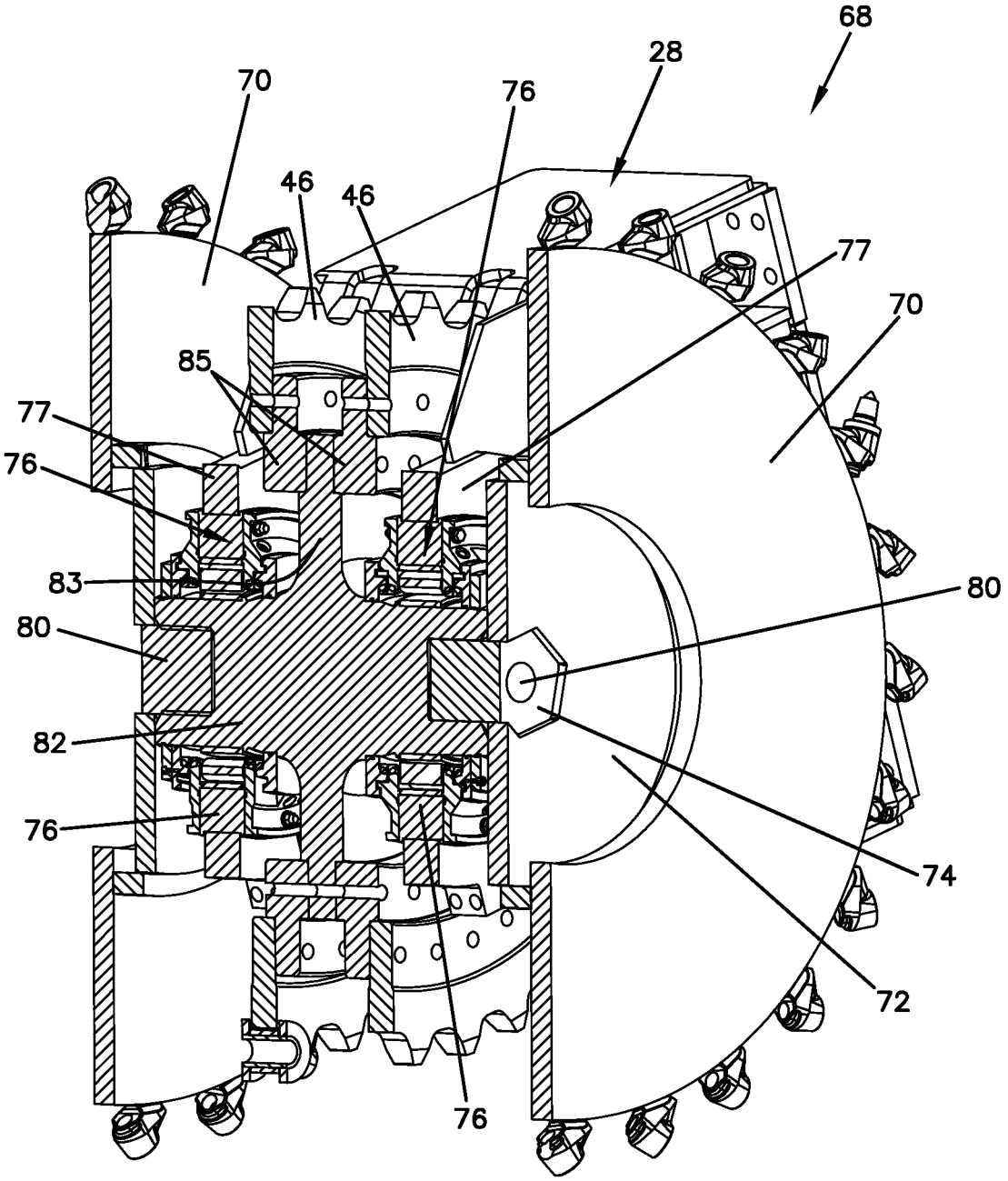
FIG. 11 is a front-side isometric cut-away view of the distal end of the trencher boom in FIG. 9, as viewed along Line T.

FIGS. 9-11 depict a distal end 68 of the boom according to an alternative example embodiment. The depicted distal end 68 functions similarly to the distal end 24 described above. The depicted distal end 68 includes a shaft 82 that is supported by a pair of bearing assemblies 76. The bearing assemblies 76 are supported by a clamp 77 that is secured to the boom frame 26. This relationship allows the shaft 82 to rotate with respect to the boom frame 26, preferably with one degree of freedom.

The shaft 82 includes a flange 83 that is fixed to the sprocket 46 through a pair of mount features 85, for example with a fastener or welding, or in a manner understood by one of ordinary skill in the art. In operation, the shaft 82 rotates in unison with the sprocket 46 driven by the chain 34, in a similar operation to that described above.

The shaft 82 includes a pair of receiver bores 78 that receive a pair of insert mounts 74 that are secured to the shaft with a fastener 80, for example a pin or bolt. As depicted, the receiver bores 78 have a non-circular shape, for example hexagonal. Each insert mount 74 has a matching shape that engages the inner surfaces of the receiver bores 78. A hub 72 and a widener 70 are fixed to each insert mount 74, for example through welding or fasteners. In operation, the interaction of each insert mount 74 and each receiver bore 78 forces the wideners 70, hubs 72, and shaft 82 to rotate in unison with the sprocket 46 and with respect to the boom frame 26. This mechanical effect causes torque to be transferred to the wideners 70 from the shaft 82 through the engaging surfaces of the receiver bores 78 and insert mounts 74. Similarly to the distal end 24 above, the depicted distal end 68 can alternatively cut a trench when the wideners 70 are removed from the shaft 82, thus cutting a narrower trench channel.

The depicted wideners 70 have teeth oriented similarly to the wideners 32 described above. The depicted wideners 70 rotate in a similar direction to the wideners 32 described above.

Figures 12A, 12B, 12C, 12D, 12E:
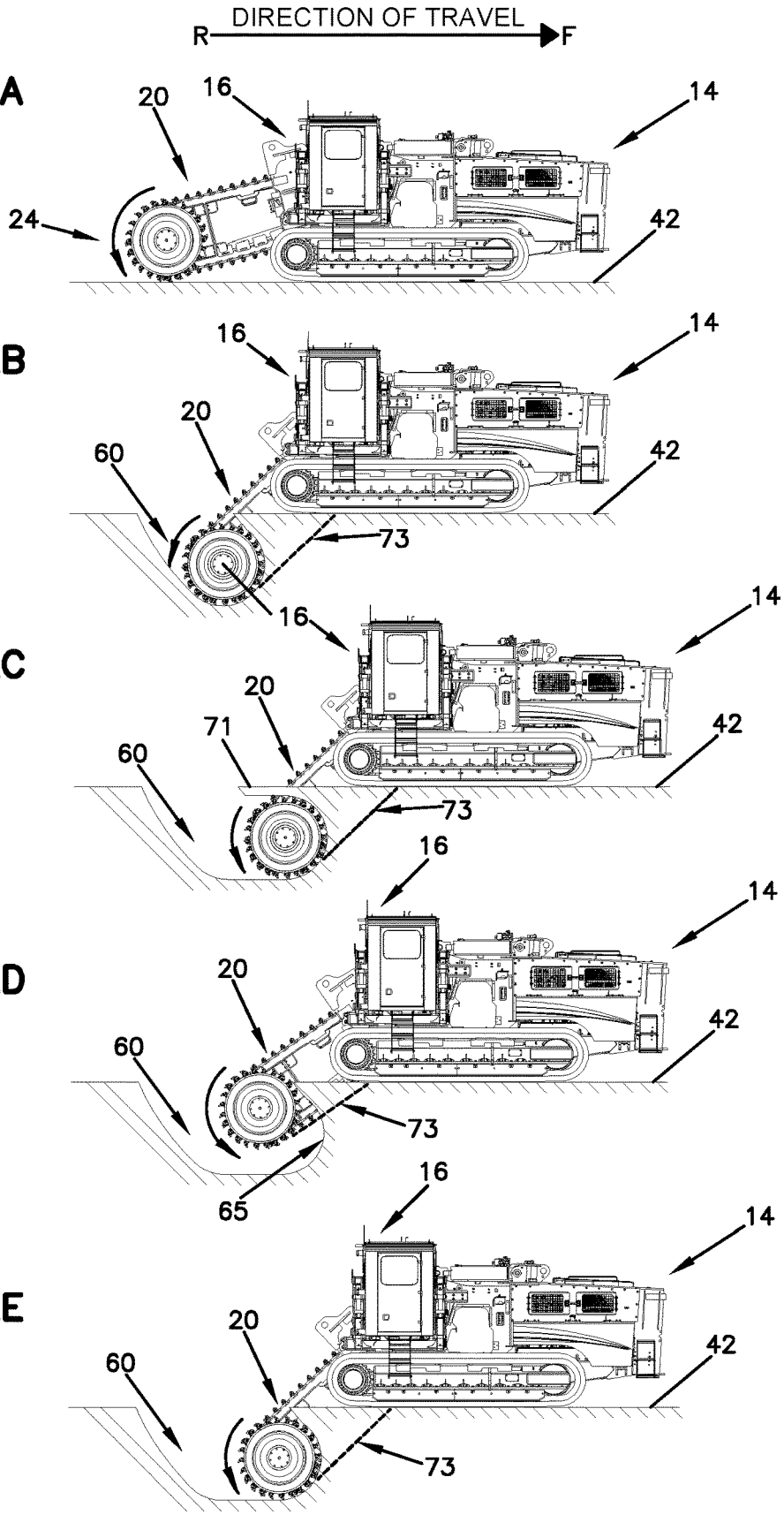
FIGS. 12A-12E show the progression of steps in a method of cutting a trench using the trencher shown in FIG. 1.

As shown particularly in FIG. 12A-12B, during operation, the boom 20 pivotally cuts downwardly and forwardly F from the rear end 16 of the chassis 12 with respect to the direction of travel. As particularly depicted in FIG. 12C, the trencher 10 travels forward F along the direction of travel, and the described drum sections and chain cut into the front end face 65 of the trench 60. The described drum sections create an undercut section 71 into the front end face 65 of the trench 60 below the ground surface 42. Since the chain is providing a cutting action at the bottom side of the trencher boom and the chain extends all the way from the bottom of the trench to above ground surface 42, the chain cuts a section 73 that does not create an undercut into the front end face of the trench, as indicated by the broken lines in FIGS. 12B-12E. As particularly depicted in FIG. 12D, the boom 20 is then raised upwardly and rearwardly R from the rear end 16 of the chassis, thus also raising the distal portion upwardly and away from the front end face 65 of the trench 60. During this movement, the top of the described drum sections cut the undercut sections 71 away from the front end face 65 of the trench 60. FIG. 12E depicts the first stage in a repetition of the actions described in FIGS. 12A-12D. The trencher 10 draws the spoils (not shown) up along the bottom side 30 of the boom 20, the spoils effectively being trapped between the bottom side 30 of the boom 20 and the trench 60, until cleared of the trench.

Figure 13A:
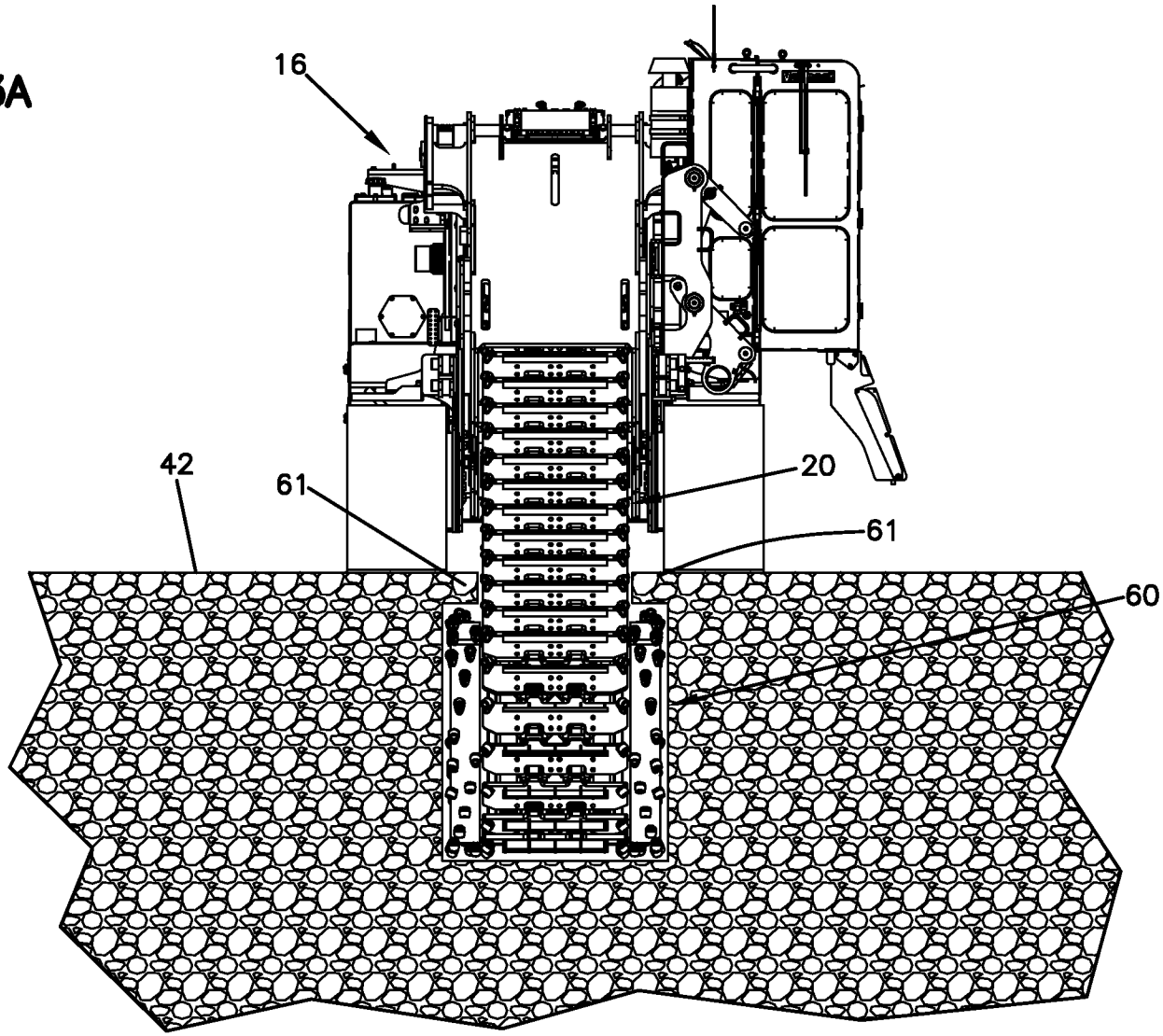
FIGS. 13A-13C show the trench profile shown in FIGS. 12A-12E during and after cutting the trench.
Figure 13B:
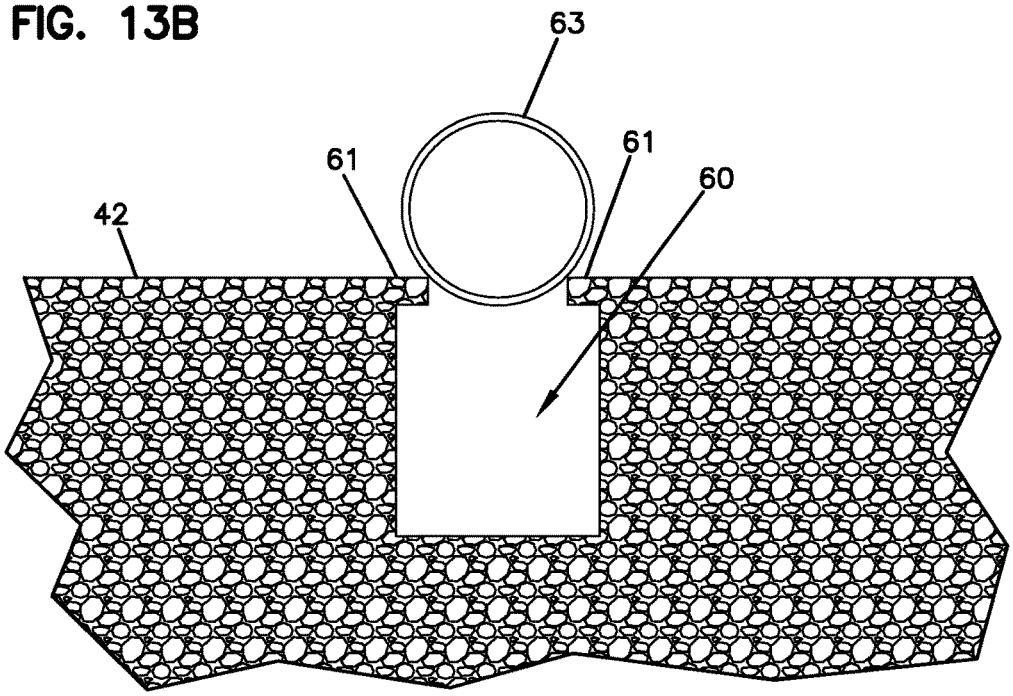
Figure 13C:
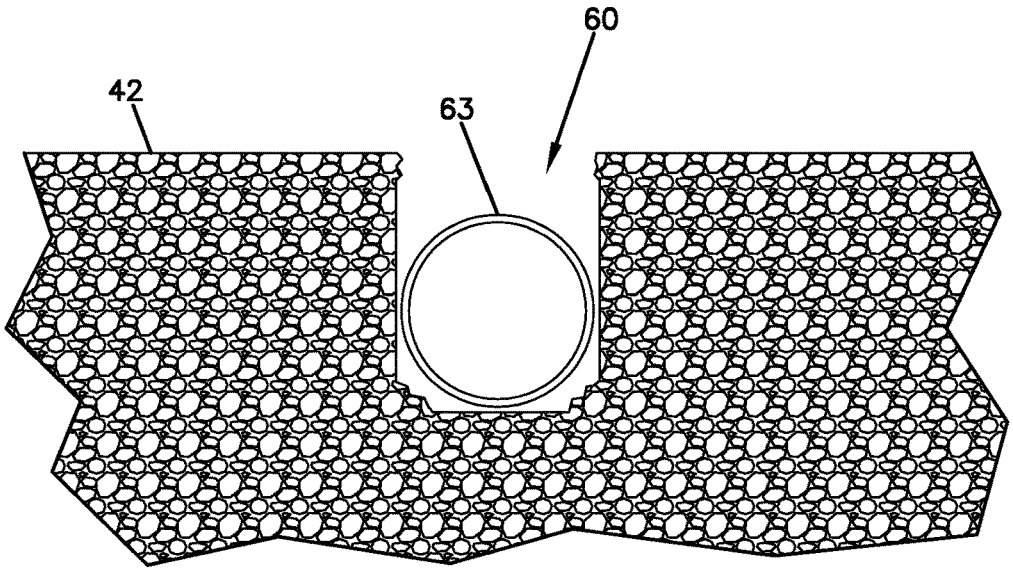

As alternatively shown in FIGS. 13A-13C, the trencher boom 20 can be consistently lowered and engaged into the ground surface 42, similarly to the position shown in FIGS. 12B-12C. During forward F travel, the distal portion 24 of the trencher boom 20 cuts below the ground surface 42, and the trencher boom 20 and chain 34 cut through the ground surface. The distal portion 24 of the trencher boom 20 can be kept in this lowered position during continued forward F travel, thus cutting an extended length of the undercut section. As specifically shown in FIG. 13A, the disparity in width between trench width A at the boom distal portion 24 and trench width B along the length of the trencher boom 20 (FIG. 8) causes overhanging ledges 61 to remain uncut over the drum sections 36 on either side of the trencher boom 20. As specifically shown in FIG. 13B, the overhanging ledges 61 narrow the top opening of the trench 60. The overhanging ledges 61 can each have a narrow width defined by the width of the drum sections 36, as described above with respect to FIG. 8. Thus, the opening between the overhanging ledges 61 is defined by the width B of the chain 34 on the boom 20. As is contemplated and shown, a pipe 63 can have a diameter that is wider than the width B of the boom 20, thus preventing the pipe from immediately falling into the trench 60. As shown, the pipe 63 rests atop and between each overhanging ledge 61. As specifically shown in FIG. 13C, the weight of the pipe 63, or gravity, forces the overhanging shelves 61 to slough off to the bottom of the trench, thus also causing the pipe to set within the trench. For this reason, although the overhanging ledges 61 can narrow the opening of the trench 60, it is possible to still insert a larger diameter pipe 63 into the trench.

Figure 14:
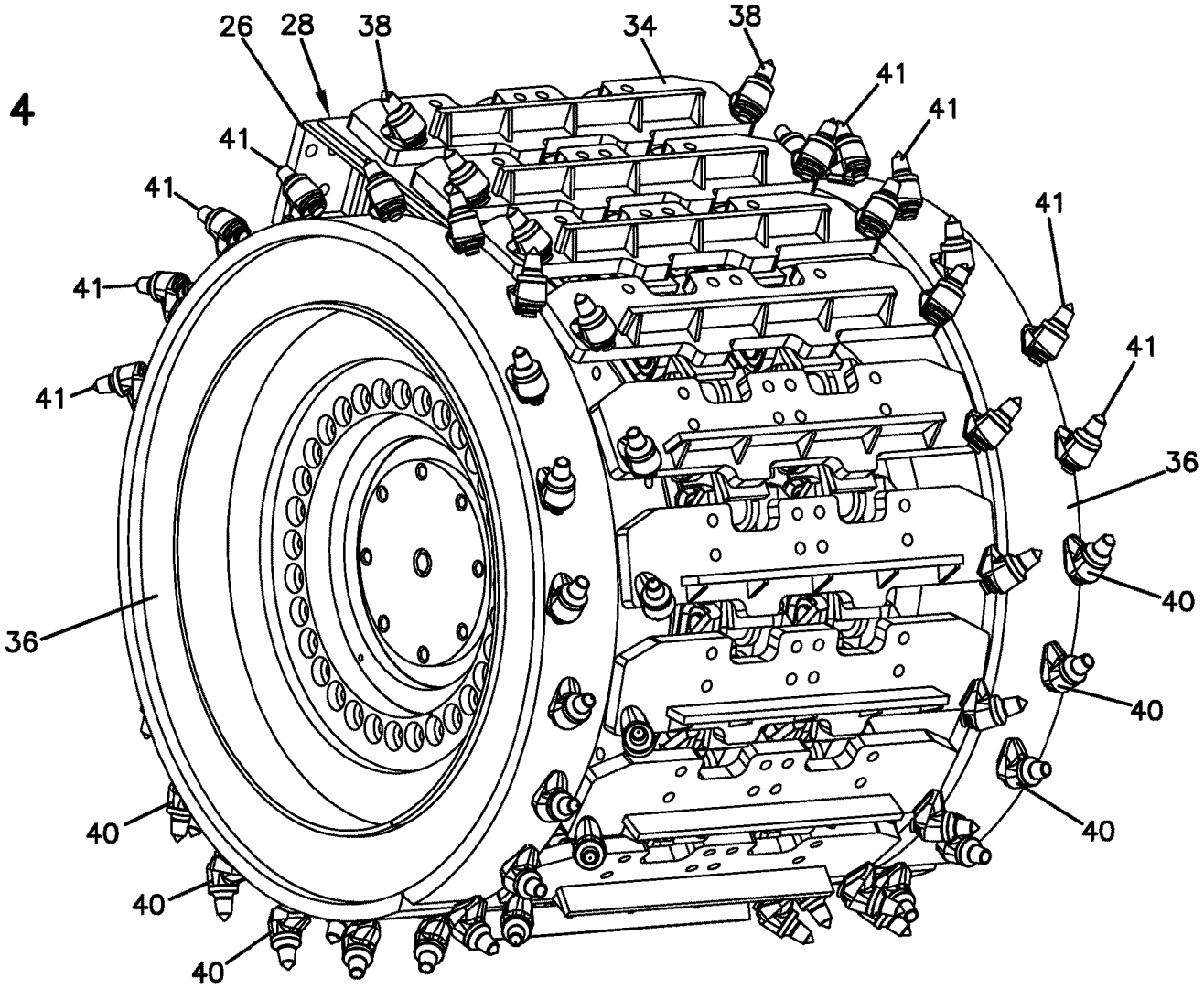
FIG. 14 is a front-side isolated isometric view of the distal end of the trencher boom shown in FIG. 1, depicting an alternative orientation from that shown in FIG. 5.

As alternatively depicted in FIG. 14, the example cutter pockets 40, drum cutters 41, and chain cutters 38 can be alternatively oriented to face at least partially in a rearward R direction toward the chassis 12 when traveling along the bottom side 30 of the trencher boom 20, and face at least partially in a forward F direction away from the chassis when traveling along the top side 28 of the trencher boom. These forward F and rearward R directions of the cutters 38 are in reference to the direction of travel of the trencher 10 (FIGS. 12A-12E). During operation of this alternative depiction, the trenching chain 34 can be driven in a first direction in which the trenching chain transitions from the top side 28 of the trenching boom 20 to the bottom side 30 of the trenching boom at the proximal end 22 of the trenching boom, and transitions from the bottom side of the trenching boom to the top side of the trenching boom at the distal end 24 of the trenching boom.

PARTS LIST

10 Trencher
12 Chassis
14 Front End
16 Rear End
18 Propulsion System
20 Boom
22 Proximal End
24 Distal End
26 Boom Frame
28 Top Side
30 Bottom Side
32 Widener
34 Chain
36 Drum
38 Chain Cutter
40 Cutter Pocket
41 Drum Cutter
42 Ground Surface
44 Drive Mechanism
46 Sprocket
47 Teeth
48 Shaft
50 Hub
52 Fitting
54 Bearing
56 Fastener
59 Fastener
60 Trench
61 Overhanging Ledge
63 Pipe
65 Front Face
68 Distal End
70 Wideners
71 Undercut Section
72 Hubs
73 Non-Undercut Section
74 Receiver Bore Insert
76 Bearing

77 Clamp
78 Receiver Bore
80 Fastener
82 Shaft
83 Shaft Flange
85 Mount
$L_1$ First Axis
$L_2$ Second Axis

We claim:

1. A trencher comprising:

a chassis having a front end and a back end;

a propulsion system for moving the chassis forward and rearward;

a trencher boom mounted to the back end of the chassis, the trencher boom being pivotally movable relative to the chassis between a raised position and a lowered position, the trencher boom including proximal end pivotally mounted to the chassis and a distal end, the trencher boom defining a longitudinal axis that extends between the proximal and distal ends of the boom, the trencher boom also including a boom frame that extends longitudinally along the longitudinal axis of the boom, the trencher boom having a top side and a bottom side;

the trencher boom including a first trenching portion at the distal end of the boom and a second trenching portion that extends along the longitudinal axis from the first trenching portion toward the proximal end, the first trenching portion defining a first trench width and the second trenching portion defining a second trench width, the first trench width being larger than the second trench width, the first trenching portion having a length measured along the longitudinal axis that is less than one half of a total length of the trencher boom;

the trencher boom including a trenching chain that moves along a continuous path that extends around a length of the boom frame, the trenching chain defining a chain width that corresponds to the second trench width, the chain turning about a first axis at the proximal end of the boom and a second axis at the distal end of the boom;

the trencher boom including first and second trench wideners positioned only at the distal end of the trencher boom on opposite sides of the trenching chain, the first and second trench wideners being configured to rotate only about the second axis as the chain is driven along the continuous path, the first and second trench wideners cooperating to define outer extents of the first trench width, and each of the first and second trench wideners having a cutting width that is less than 0.75 times as large as the chain width;

the trenching chain including a main chain body and a plurality of chain cutters carried with the main chain body, wherein the chain cutters are oriented such that tips of the chain cutters face at least partially in a first direction towards the distal end of the boom when the chain cutters are traveling along the top side of the trencher boom and face at least partially in a second direction away from the distal end of the boom when the chain cutters are traveling along the bottom side of the trencher boom; and the first and second trench wideners respectively including first and second drum sections that include a plurality of drum cutters mounted to exterior surfaces thereof, wherein the drum cutters are oriented such that tips of the drum cutters face at least partially in the first direction when the drum cutters are directly over their respective first and second drum sections and face at least partially in the second direction when the drum cutters are directly under their respective first and second drum sections, wherein the first and second drum sections rotate about the second axis such that the drum cutter tips are rotated towards the distal end of the boom when the drum cutters are directly over their respective first and second drum sections and such that the drum cutter tips are rotated away from the distal end of the boom when the drum cutters are directly under their respective first and second drum sections;

wherein, during operation, the distal end of the boom trails the proximate end of the boom such that the trencher draws the spoils up along the bottom side of the boom.

2. The trencher of claim 1, further comprising a drive mechanism for driving the trenching chain about the continuous path, wherein, during trenching, the trenching chain is driven in a first direction in which the trenching chain transitions from the top side of the trencher boom to the bottom side of the trencher boom at the distal end of the trencher boom and transitions from the bottom side of the trencher boom to the top side of the trencher boom at the proximal end of the trencher boom.

3. The trencher of claim 1, wherein the propulsion system includes tracks or tires.

4. The trencher of claim 1, wherein the main body of the trenching chain rides on a sprocket at the distal end of the trencher boom, wherein the sprocket rotates about the second axis, wherein the second axis is defined by a shaft that is fixed relative to the boom frame, wherein the sprocket is mounted to the shaft by at least one bearing that allows the sprocket to rotate about the shaft, and wherein the first and second drum sections rotate in unison with the sprocket about the second axis.

5. The trencher of claim 4, wherein the first and second drum sections are mechanically coupled to the sprocket.

6. The trencher of claim 4, wherein the first and second drum sections are each releasably coupled to a hub that rotates in unison with the sprocket.

7. The trencher of claim 6, wherein each hub is secured to the sprocket.

8. The trencher of claim 4, wherein the shaft is fixed relative to the boom frame by a fitting.

9. The trencher of claim 4, wherein the shaft width is narrower than the second trench width.

10. The trencher of claim 4, wherein the sprocket includes a plurality of teeth that engage the chain.

11. The trencher of claim 4, wherein the chain rotates about the shaft around the boom distal end from the top side to the bottom side.

12. The trencher of claim 1, wherein, during operation, the boom is raised upward and away from a front end face of a trench.

13. The trencher of claim 1, wherein, during operation, the first and second drum sections create an undercut into a front end face of a trench.

14. The trencher of claim 13, wherein the chain does not create an undercut into the front end face of the trench.

15. The trencher of claim 1, wherein, during operation, the boom cuts downwardly and rearwardly from the chassis.

16. The trencher of claim 1, wherein the cutting widths of the first and second trench wideners are each less than 0.50 times as large as the chain width.

17. A convertible trencher comprising:

a chassis having a front end and a back end;

a propulsion system for moving the chassis forward and rearward;

a trencher boom mounted to the back end of the chassis, the trencher boom being pivotally movable relative to the chassis between a raised position and a lowered position, the trencher boom including proximal end pivotally mounted to the chassis and a distal end, the trencher boom defining a longitudinal axis that extends between the proximal and distal ends of the boom, the trencher boom also including a boom frame that extends longitudinally along the longitudinal axis of the boom, the trencher boom having a top side and a bottom side;

the trencher being convertible between first and second trenching configurations;

wherein, when the trencher is in the first trenching configuration, the trencher boom includes a first trenching portion rotatable only about a distal axis positioned only at the distal end of the boom and a second trenching portion that extends along the longitudinal axis from the first trenching portion toward the proximal end, the second trenching portion being rotatable about a proximal axis at the proximal end of the boom and the distal axis at the distal end of the boom, the first trenching portion defining a first trench width and the second trenching portion defining a second trench width, the first trench width being larger than the second trench width, the second trenching portion having a greater length measured along the longitudinal axis as compared to the first trenching portion, wherein the trencher in the first trenching configuration includes a plurality of drum cutters mounted to the exterior surface of a pair of drum sections rotatable about the distal axis, the plurality of drum cutters facing at least partially in a first direction towards the distal end of the boom when the drum cutters are traveling along a top side of the trencher boom and face at least partially in a second direction away from the distal end of the boom when the drum cutters are traveling along a bottom side of the trencher boom;

wherein the drum cutters are rotated towards the distal end of the boom when the drum cutters are traveling along a top side of the trencher boom and such that the drum cutters are rotated away from the distal end of the boom when the drum cutters are traveling along a bottom side of the trencher boom;

wherein, when the trencher is in the second trenching configuration, the trencher boom is configured to only trench the second trenching width, and wherein, during operation, the distal end of the boom trails the proximate end of the boom such that the trencher draws the spoils up along the bottom side of the boom.

18. A trencher comprising:

a chassis having a front end and a back end;

a propulsion system for moving the chassis forward and rearward;

a trencher boom mounted to the back end of the chassis, the trencher boom being pivotally movable relative to the chassis between a raised position and a lowered position, the trencher boom including proximal end pivotally mounted to the chassis and a distal end, the trencher boom defining a longitudinal axis that extends between the proximal and distal ends of the boom, the trencher boom also including a boom frame that extends longitudinally along the longitudinal axis of the boom, the trencher boom having a top side and a bottom side;

the trencher boom including a first trenching portion at the distal end of the boom and a second trenching portion that extends along the longitudinal axis from the first trenching portion toward the proximal end, the first trenching portion defining a first trench width and the second trenching portion defining a second trench width, the first trench width being larger than the second trench width, the second trenching portion having a greater length measured along the longitudinal axis as compared to the first trenching portion;

the trencher boom including a trenching chain that moves along a continuous path that extends around a length of the boom frame, the trenching chain defining a chain width that corresponds to the second trench width, the chain turning about a first axis at the proximal end of the boom and a second axis at the distal end of the boom;

the trencher boom including first and second trench wideners removably positioned only at the distal end of the trencher boom on opposite sides of the trenching chain, the first and second trench wideners being configured to rotate only about the second axis as the chain is driven along the continuous path, the first and second trench wideners cooperating to define outer extents of the first trench width;

the trenching chain rides on a sprocket at the distal end of the trencher boom, wherein the sprocket rotates about the second axis, wherein the second axis is defined by a shaft that is fixed relative to the boom frame, wherein the sprocket is mounted to the shaft by at least one bearing that allows the sprocket to rotate about the shaft, and wherein the first and second trench wideners rotate in unison with the sprocket about the second axis, wherein the shaft width is narrower than the second trench width such that the trenching chain can cut the second trench width without the removable wideners wherein during operation, the distal end of the boom trails the proximate end of the boom such that the trencher draws the spoils up along the bottom side of the boom wherein the trenching chain comprises a main chain body and a plurality of chain cutters carried with the main chain body, wherein the chain cutters are oriented such that tips of the chain cutters face at least partially in a first direction towards the distal end of the boom when the chain cutters are traveling along the top side of the trencher boom and face at least partially in a forward second direction away from the distal end of the boom when the chain cutters are traveling along the bottom side of the trencher boom; and the first and second trench wideners respectively including first and second drum sections carrying a plurality of drum cutters, wherein the drum cutters are oriented such that tips of the drum cutters face at least partially in the first direction when the drum cutters are directly over their respective first and second drum sections and face at least partially in the second direction when the drum cutters are directly under their respective first and second drum sections;

wherein the first and second drum sections rotate about the second axis such that the drum cutter tips are rotated towards the distal end of the boom when the drum cutters are directly over their respective first and second drum sections and such that the drum cutter tips are rotated away from the distal end of the boom when the drum cutters are directly under their respective first and second drum sections.

* * * * *